US008671699B2

(12) United States Patent
Rosetta et al.

(10) Patent No.: US 8,671,699 B2
(45) Date of Patent: Mar. 18, 2014

(54) METHOD AND SYSTEM FOR VAPORIZING LIQUEFIED NATURAL GAS WITH OPTIONAL CO-PRODUCTION OF ELECTRICITY

(75) Inventors: Martin J. Rosetta, Houston, TX (US); Bill R. Minton, Houston, TX (US); David A. Franklin, Katy, TX (US)

(73) Assignee: Black & Veatch Holding Company, Kansas City, MO (US)

( * ) Notice: Subject to any disclaimer, the term of this patent is extended or adjusted under 35 U.S.C. 154(b) by 0 days.

(21) Appl. No.: 13/068,732

(22) Filed: May 18, 2011

(65) Prior Publication Data

US 2012/0090324 A1 Apr. 19, 2012

Related U.S. Application Data

(62) Division of application No. 12/228,651, filed on Aug. 15, 2008, now abandoned, which is a division of application No. 11/133,762, filed on May 19, 2005, now abandoned.

(51) Int. Cl.
*F17C 9/02* (2006.01)

(52) U.S. Cl.
USPC ..... 62/50.2; 60/39.5

(58) Field of Classification Search
USPC ..... 62/50.2, 50.3, 50.5
See application file for complete search history.

(56) References Cited

U.S. PATENT DOCUMENTS

| | | | | |
|---|---|---|---|---|
| 3,596,472 A | | 8/1971 | Streich | |
| 3,915,680 A | | 10/1975 | Crawford et al. | |
| 4,033,735 A | | 7/1977 | Swenson | |
| 4,036,028 A | * | 7/1977 | Mandrin | 62/50.3 |
| 4,157,904 A | | 6/1979 | Campbell et al. | |
| 4,278,457 A | | 7/1981 | Campbell et al. | |
| 4,311,496 A | | 1/1982 | Fabian | |
| 4,664,686 A | | 5/1987 | Pahade et al. | |
| 4,878,932 A | | 11/1989 | Phade et al. | |
| 5,051,120 A | | 9/1991 | Pahade et al. | |
| 5,182,920 A | | 2/1993 | Matsuoka et al. | |
| 5,379,597 A | | 1/1995 | Howard et al. | |
| 5,398,497 A | * | 3/1995 | Suppes | 60/775 |
| 5,502,972 A | | 4/1996 | Howard et al. | |
| 5,520,724 A | | 5/1996 | Bauer et al. | |
| 5,596,883 A | | 1/1997 | Bernhard et al. | |
| 5,657,643 A | | 8/1997 | Price | |
| 5,771,712 A | | 6/1998 | Campbell et al. | |
| 6,023,942 A | | 2/2000 | Thomas et al. | |
| 6,053,008 A | | 4/2000 | Arman et al. | |

(Continued)

FOREIGN PATENT DOCUMENTS

| | | | | |
|---|---|---|---|---|
| JP | 2000018049 A | * | 1/2000 | F02C 7/143 |
| JP | 2002005398 A | * | 1/2002 | F17C 9/02 |
| JP | 2003232226 A | * | 8/2003 | F02C 7/143 |

OTHER PUBLICATIONS

Machine translation of JP 2000018049 A.*

(Continued)

*Primary Examiner* — John Pettitt

(74) *Attorney, Agent, or Firm* — Hovey Williams LLP

(57) ABSTRACT

A process for the use of ambient air as a heat exchange medium for vaporizing cryogenic fluids wherein the vaporized cryogenic gases are heated to a selected temperature for use or delivery to a pipeline.

10 Claims, 3 Drawing Sheets

(56) References Cited

U.S. PATENT DOCUMENTS

| | | | |
|---|---|---|---|
| 6,070,430 | A | 6/2000 | McNeil et al. |
| 6,085,546 | A | 7/2000 | Johnston |
| 6,105,390 | A | 8/2000 | Bingham et al. |
| 6,260,380 | B1 | 7/2001 | Arman et al. |
| 6,266,977 | B1 | 7/2001 | Howard et al. |
| 6,295,833 | B1 | 10/2001 | Hoffart et al. |
| 6,311,516 | B1 | 11/2001 | Key et al. |
| 6,330,811 | B1 | 12/2001 | Arman et al. |
| 6,367,286 | B1 | 4/2002 | Price |
| 6,427,483 | B1 | 8/2002 | Rashad et al. |
| 6,662,589 | B1 | 12/2003 | Roberts et al. |
| 6,725,688 | B2 | 4/2004 | Elion et al. |
| 6,915,662 | B2 | 7/2005 | Wilkinson et al. |
| 6,925,837 | B2 | 8/2005 | Eaton |
| 7,051,553 | B2 | 5/2006 | Mak et al. |
| 7,069,744 | B2 | 7/2006 | Patel et al. |
| 7,100,399 | B2 | 9/2006 | Eaton |
| 7,152,428 | B2 | 12/2006 | Lee et al. |
| 7,216,507 | B2 | 5/2007 | Cuellar et al. |
| 7,266,975 | B2 | 9/2007 | Hupkes et al. |
| 7,310,972 | B2 | 12/2007 | Yoshida et al. |
| 7,357,003 | B2 | 4/2008 | Ohara et al. |
| 7,484,385 | B2 | 2/2009 | Patel et al. |
| 7,713,497 | B2 | 5/2010 | Mak |
| 7,818,979 | B2 | 10/2010 | Patel et al. |
| 2003/0046953 | A1 | 3/2003 | Elion et al. |
| 2004/0159122 | A1 | 8/2004 | Patel et al. |
| 2007/0231244 | A1 | 10/2007 | Shah et al. |
| 2008/0264076 | A1 | 10/2008 | Price et al. |
| 2009/0205367 | A1 | 8/2009 | Price |
| 2012/0090324 | A1 | 4/2012 | Rosetta et al. |

OTHER PUBLICATIONS

Machine translation of JP 2002005398 A.*

Machine translation of JP 2003232226 A.*

Gas Processor Suppliers Association (GPSA) Engineering Databook, Section 16 entitled "Hydrocarbon Recovery" p. 16-13 through 16-20, 12th Ed. (copyright 2004).

* cited by examiner

METHOD AND SYSTEM FOR VAPORIZING LIQUEFIED NATURAL GAS WITH OPTIONAL CO-PRODUCTION OF ELECTRICITY

This is a divisional of application Ser. No. 12/228,651 filed Aug. 5, 2008. Ser. No. 12/228,651 is a divisional application of Ser. No. 11/133,762.

FIELD OF THE INVENTION

The present invention relates to an improved process for the use of ambient air as a heat exchange medium for vaporizing cryogenic fluids.

BACKGROUND OF THE INVENTION

In many areas of the world, large natural gas deposits are found. These natural gas deposits, while constituting a valuable resource, have little value in the remote areas in which they are located. To utilize these resources effectively, the natural gas must be moved to a commercial market area. This is frequently accomplished by liquefying the natural gas to produce a liquefied natural gas (LNG), which is then transported by ship or the like to a market place. Once the LNG arrives at the marketplace, the LNG must be revaporized for use as a fuel, for delivery by pipeline and the like. Other cryogenic liquids frequently require revaporization after transportation also, but by far the largest demand for processes of this type is for cryogenic natural gas revaporization.

In many instances the natural gas is revaporized by the use of seawater as a heat exchange medium, by direct-fired heaters and the like. Each of these methods is subject to certain disadvantages. For instance, there are concerns about the use of seawater for environmental and other reasons. Further, seawater in many instances is prone to contaminate heat exchange surfaces over periods of time. The use of direct-fired heaters requires the consumption of a portion of the product for heating to revaporize the remainder of the LNG.

While in some instances, air has been used as a heat exchange medium for LNG, the use of air has not been common because of the large heat transfer area required in the heat exchangers and because of the variable temperature of air during different seasons, during the day and night, and the like. Other disadvantages associated with the use of air relate to the formation of ice in the heat exchange vessels, the requirement for large amounts of air to heat the revaporized natural gas to a suitable temperature for delivery to a user or to a pipeline and the like. The use of such large volumes of air can require either excessively large heat exchange vessels or the use of excessive amounts of air, which may result in excessive expense for forced air equipment, high operating costs and the like. Accordingly, improved methods have continually been sought for more economically and effectively revaporizing cryogenic liquids.

SUMMARY OF THE INVENTION

According to the present invention, an improved method for vaporizing a cryogenic liquid is provided, comprising passing the cryogenic liquid in heat exchange contact with air to vaporize the cryogenic liquid and produce a gas and heating the gas to a selected temperature by heat exchange with a heated liquid stream.

The invention further comprises: a method for vaporizing a cryogenic liquid by passing the cryogenic liquid in heat exchange contact with air in a heat exchange zone to vaporize the cryogenic liquid to produce a gas; heating the air passed in heat exchange with the cryogenic liquid by heat exchange with a heated liquid stream; and, heating the gas to a selected temperature by heat exchange with a heated liquid stream.

The invention additionally comprises a method for vaporizing a cryogenic liquid by: passing the cryogenic liquid in heat exchange contact with air in a heat exchange zone to vaporize the cryogenic liquid to produce a gas; and, heating the air passed in heat exchange with the cryogenic liquid by heat exchange with a heated liquid stream.

The invention also comprises a system for vaporizing a cryogenic liquid, the system comprising: at least one heat exchanger having an air inlet, an air outlet, a cryogenic liquid inlet and a gas outlet and adapted to pass air in heat exchange contact with the cryogenic liquid to produce a gas; and, a heater having a cryogenic liquid inlet in fluid communication with the gas outlet from the heater and a heated gas outlet.

BRIEF DESCRIPTION OF THE DRAWINGS

In the description of the FIGs, the same numbers will be used throughout to refer to the same or similar components.

DESCRIPTION OF PREFERRED EMBODIMENTS

In the description of the Figures, the same numbers will be used throughout to refer to the same or similar components. Not all pumps, valves and other control elements have been shown in the interest of simplicity.

Figure 1:
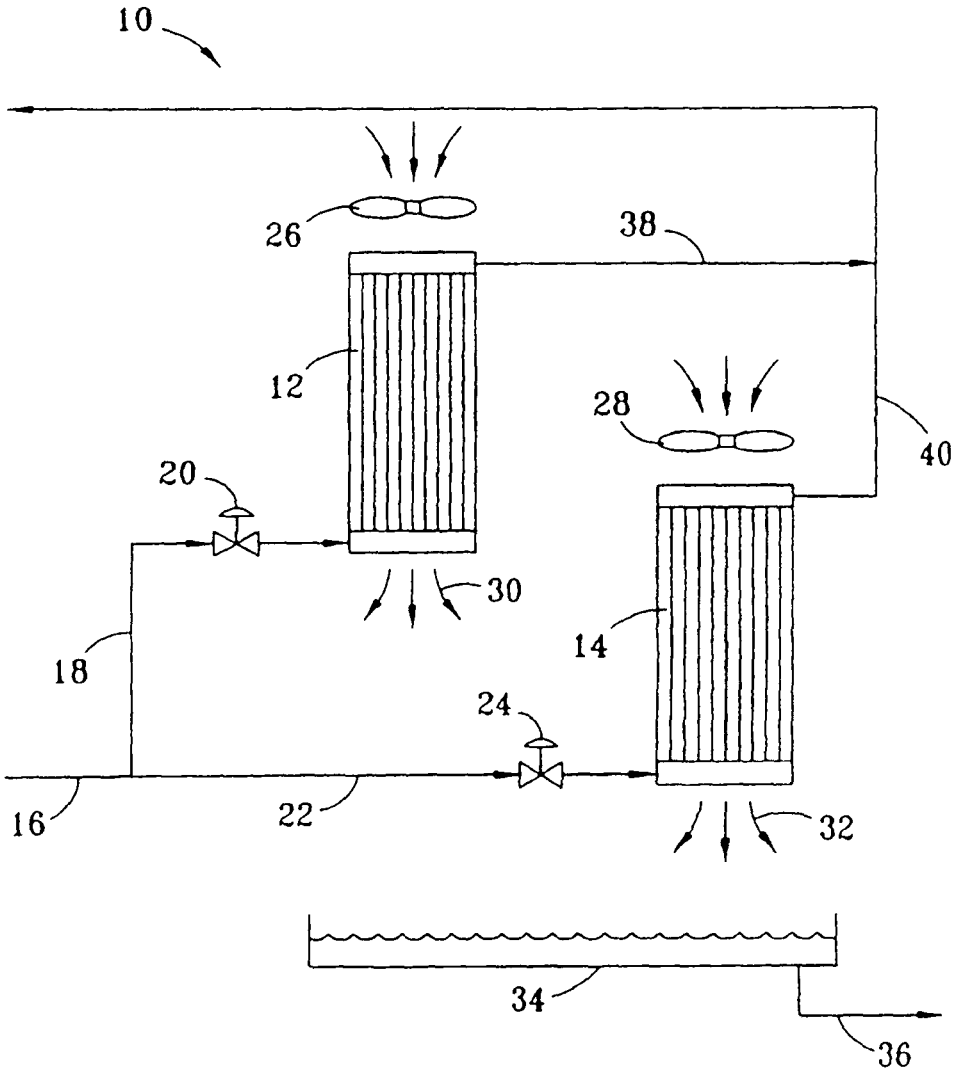
FIG. 1 (PRIOR ART)
FIG. 1. is a schematic diagram of a prior art revaporization process wherein air is used as a heat exchange fluid.

In FIG. 1, a typical system 10 for revaporizing a cryogenic liquid, according to the prior art, is shown. In this system a first heat exchanger 12, typically having extended heat exchange surfaces, is used along with a second heat exchanger 14, which also typically has extended heat exchange surfaces. A cryogenic liquid is injected through an inlet line 16. This liquid may be passed to one or both of vessels 12 or 14. However, it is typically passed to only one of vessels 12 or 14 at a given time.

For instance, the cryogenic liquid may be passed through line 18 and valve 20 into heat exchanger 12 and vaporized by heat exchange with air and passed as vaporized gas through a line 38 to a line 40 for recovery. Air is passed through heat exchanger 12, naturally by gravity or more typically by a forced air system, shown schematically as a fan 26, with the air being exhausted as shown by arrows 30. After a period of time the air, which typically contains some humidity, will precipitate water. This water typically freezes on the heat exchange surface in the lower portion of heat exchanger 12. At this point, the cryogenic liquid is rerouted through line 22 and valve 24 to heat exchanger 14 for vaporization for a period of time so that heat exchanger 12 may thaw. This thaw may be accomplished, for instance, by use of a continued flow of ambient air through heat exchanger 12 so that it becomes reusable to vaporize additional quantities of cryogenic liquid.

Heat exchanger 14 operates in the same manner described in connection with heat exchanger 12. The recovered, vaporized gas is passed through a line 40 for recovery with the air being forced through heat exchanger 14 by a forced air system. This is shown schematically by a fan 28 with the air being recovered as shown by arrow 32. Water recovery is shown at 34 with the recovered water being passed, as shown by arrow 36, to use for irrigation or other purposes or passed to suitable treatment for disposal.

Processes of this type are known to those skilled in the art. While these processes have been effective, they are subject to certain disadvantages. For instance, the driving temperature between the inlet air and the discharged natural gas may be relatively small during times of low temperatures. In such instances, it is necessary to use a larger quantity of air to achieve the desired temperature in line 40 for delivery to a user, a pipeline or the like. Further, the driving temperature throughout the heat exchangers is reduced when the air temperature is lower. This is particularly acute when the air temperature drops to temperatures near the desired temperature in the pipeline. In such instances, it requires larger amounts of air to achieve the desired temperature.

Figure 2:
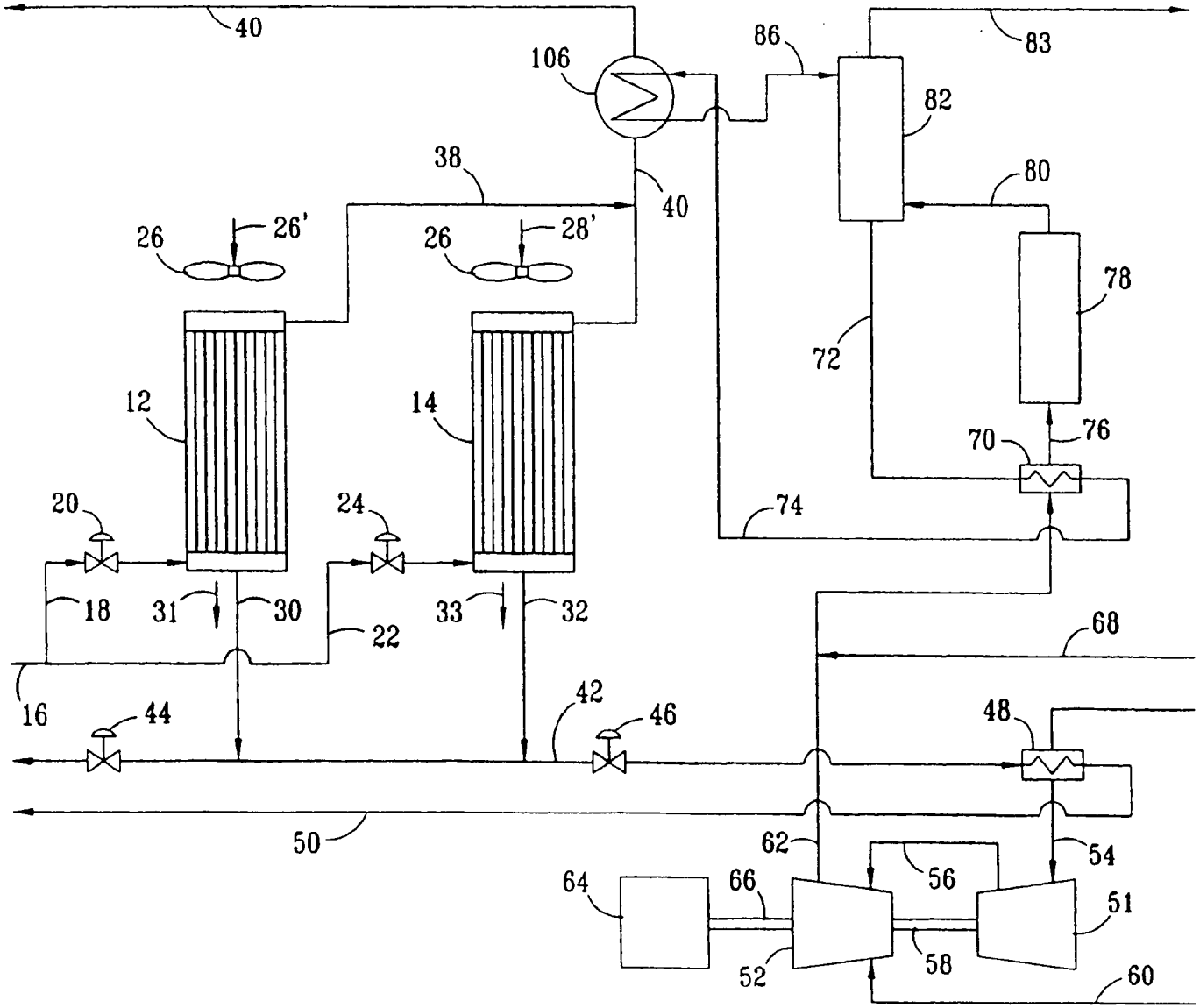
FIG. 2. is a schematic diagram of an embodiment of the present invention; and, FIG. 3 is a schematic diagram of a further embodiment of the method of the present invention.

According to the present invention, an improved process is shown in FIG. 2. Heat exchangers 12 and 14 are shown. Heat exchanger 12 receives a stream of cryogenic liquid through line 18 and valve 20, as discussed previously. Air 26 is injected and passed through heat exchange 12, as discussed previously, with water being recovered and passed to a line 42, either to disposal or to use as a heat exchange fluid. The produced gas is recovered through line 38 from heat exchanger 12 and from line 40 from heat exchanger 14. Heat exchanger 14 also produces water, which is recovered through lines 32 and 42. The inlet air to heat exchangers 12 and 14 is shown by arrows 26' and 28', respectively. Flow through line 42 is regulated by valves 44 and 46, which can direct the produced water either to disposal or other use or to heat exchange with a turbine, which will be discussed later.

The produced gas in line 40, according to the present invention, is heated in a heat exchanger 106 to "trim" or boost the temperature of the gas to a desired temperature for use or for delivery to a pipeline. This boosting heat exchanger reduces the need for the use of excessive amounts of air when the temperature is relatively low and reduces the temperature required in the air, even when the temperature is at normal or low levels. In other words, the amount of air required for revaporization is reduced by reason of the subsequent heat exchange step, which increases the temperature of the produced gas. In some instances, when high temperature is present, it may not be necessary to use heat exchanger 106, but it is considered an improvement in the efficiency of the overall process to use heat exchanger 106 at all times since it reduces the amount of air required. The decision, as to whether heat exchanger 106 should be used at all air temperatures or whether reduced air flow can be used, is an economic decision and may be driven by a number of factors including consideration of the tendency of ice to form in heat exchangers 12 and 14.

As discussed previously, ice can form in either of the heat exchangers. Normally heat exchanges are provided in banks to allow the use of a portion of the heat exchangers at any given time so that certain of the heat exchangers can be withdrawn from service and allowed to thaw. Thawing can be accomplished by the use of continued air flow, by use of heated air flow or by electric coils and the like, as will be discussed further.

According to the present invention, a heating fluid is used in heat exchanger 106, which is produced by heat exchange in a quench column 82 with the exhaust gas stream from a turbine 52 or another type of fired combustion process. Turbine 52 is a turbine, as known to those skilled in the art. It typically comprises an air compressor 51, shaft coupled to the air compressor by a shaft 58, which is fed by an air inlet line 54. This provides a compressed air stream passed via a line 56 to combustion with gas supplied by a line 60 to the turbine, which produces energy by the expansion of the resulting hot gas stream to produce electrical power via an electrical power generator 64, shaft coupled by a shaft 66. The operation of such turbines to generate electrical power or power for other uses is well known to those skilled in the art and need not be discussed further.

Exhaust gas produced from the turbine operation is recovered through a line 62 and is passed to discharge or heat recovery. Prior to passing the exhaust gas stream to heat recovery, it may be further heated as shown by the use of gas or air and gas introduced through a line 68 for combustion in-line to increase the temperature of the exhaust gas. The exhaust gas may be used as a heat exchange fluid to produce electrical power and the like.

In FIG. 2 the exhaust gas, which may have been subject to heat exchange for the generation of energy or the like, is passed through a heat exchanger 70 and may be passed via a line 76 through a selective catalytic reduction NOx control unit 78. The stream recovered from unit 78 is passed via a line 80 to a quench heat exchanger 82 and subsequently discharged through a line 83. Further treatment may be used on the stream in 83 to condition it for discharge to the atmosphere or the like.

The stream from heat exchanger 106 via line 86 is heated by quenching contact with the exhaust gas stream in quench vessel 82. The heated stream from quench vessel 82 is passed through a line 72 to heat exchanger 70 where it is further heated by contact with the hot exhaust stream from turbine 52. The heated liquid stream is then passed via a line 74 to heat exchanger 106 where it heats the discharged gas stream to a desired temperature.

Desirably the liquid heat exchange stream is water, although other materials such as refrigerant, hot oil, water or other types of intermediate recirculating fluids could be used. Most such fluids require more extensive handling for heat exchange. Therefore water is a preferred recirculating liquid.

In FIG. 2, the recovered water may be passed via line 42 to heat exchange in heat exchanger 48 with the incoming air to air compressor 51, to improve the efficiency of turbine 52. The warmed water may be then discharged through line 50 to either further treatment, use, or the like.

By the use of the process shown in FIG. 2, the requirements for higher volumes of air have been reduced and improved heat exchange efficiency can be achieved in heat exchangers 12 and 14. The use of the heated exhaust stream from turbine 52 is extremely efficient economically since this is normally a waste heat stream after the recovery of its high temperature heat value. The use of the turbine exhaust stream for heat exchange to produce additional electricity and the like is typically limited to the use of the stream at a relatively high temperature whereas the process of the present invention utilizes this waste heat stream at a relatively low temperature. In other words, the heating required to increase the temperature of the gas stream to a suitable temperature for use or passage to a pipeline (usually more than about 40° F.) normally requires a heat exchange fluid which can be at a relatively low temperature, i.e., greater than about 55° F. This temperature is readily achieved in heat exchanger 106 by the use of a stream which is well below the temperature normally required for the generation of additional electric power.

The improvement by the process shown in FIG. 2 is achieved using a relatively low temperature, low pressure stream which is of limited economic value. It will be understood that typically when a turbine is used for the generation of electrical power, the heat values present in the exhaust stream are typically recovered to the extent practical for use to generate additional electric power and the like.

Figure 3:
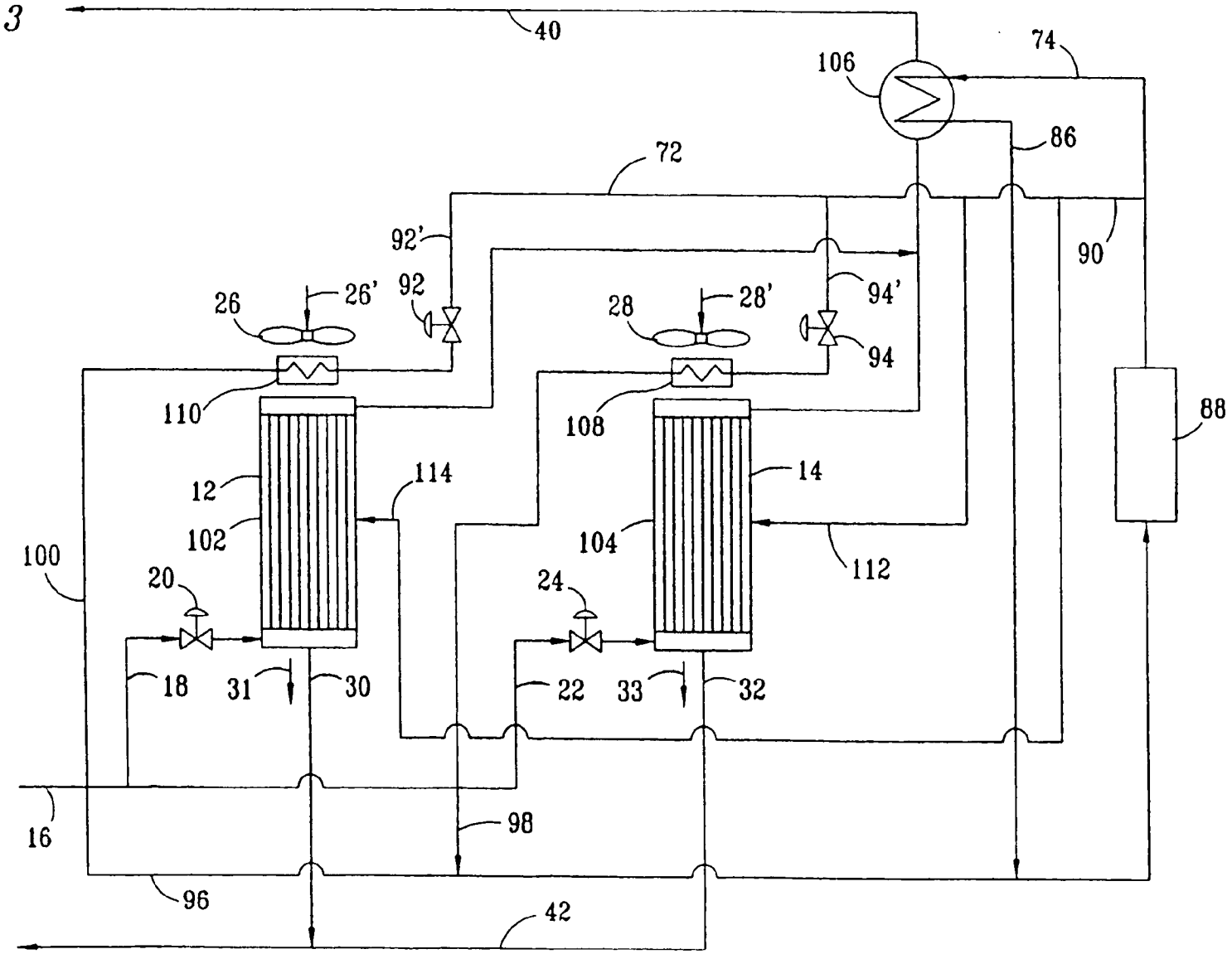

In a variation of the present invention, as shown in FIG. 3, a heat source 88 is shown, which may be a turbine with the discharge arrangement shown in FIG. 2 or an equivalent arrangement or a direct-fired heater 88. This embodiment may be used where it is not necessary to heat the natural gas at all times but rather only during certain temperature conditions and the like. The embodiment shown in FIG. 3 uses heat exchanger 106 as discussed previously.

In the embodiment shown in FIG. 3, the heated liquid in line 72 may also be utilized via a line 90 and lines 92' and 94' through valves 92 and 94 respectively, to heat the inlet air to heat exchangers 12 and 14, as shown in heaters 108 and 110, respectively. This use of the heated liquid allows the inlet air to be at an increased temperature, thereby improving the efficiency of heat exchangers 12 and 14. The cooled air and the condensed water are recovered as discussed previously and passed via line 42 to further use, treatment or the like. The cooled, heat exchange liquid is recovered through a line 98 and a line 100 and returned to heating via a line 96. Additional heated liquid may be withdrawn from line 90 through lines 112 and 114 and passed to an intermediate heating zone in a middle portion 102 of heat exchanger 12 and a middle portion 104 of heat exchanger 14. For simplicity, no return lines have been shown for this heating fluid although it is normally returned to line 96 or a separate line for return to heater 88.

By the use of the additional heating liquid to heat the inlet air and optionally heat the middle portion of heat exchangers 12 and 14, improved efficiency can be achieved because of the added temperature difference between the air stream and the cryogenic liquid or vaporized cryogenic liquid stream. Further, the heated air and the heated middle portions of the heat exchangers may be used to reduce the time necessary to remove ice from the lower portion of the heat exchangers or to prevent the formation of ice altogether.

Air heaters for the inlet air may be used alone or in combination with heater 106 and with heating streams 112 and 114. Desirably, heat exchanger 106 is used in all instances since it reduces the amount of heat required from the air streams in heat exchangers 12 and 14.

The embodiment shown in FIG. 2, which requires only heat exchanger 106, is preferred since it results in less expensive installation while still achieving the desired objectives of the present invention. As indicated previously, any waste heat stream of a suitable temperature (about 55 to about 400° F.) is effective to heat a liquid stream for use in heat exchanger 106 with a turbine having been shown since turbine exhaust streams are frequently available in areas where the unloading of cryogenic liquids is desired.

According to the present invention, improved efficiency has been achieved by a relatively simple improvement, i.e., the use of a heat exchanger on the vaporized natural gas stream with other embodiments of the invention achieving still further improvement by the use of heaters with the inlet air and with heaters in the middle portions of the air heat exchange vessels.

Accordingly, the present invention has greatly improved the efficiency of the use of ambient air as a heat exchange fluid with cryogenic liquids.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for vaporizing a liquefied natural gas stream, the method comprising:

a) heating a liquefied natural gas stream in a first heat exchanger via indirect heat exchange with an ambient air stream to thereby produce a warmed, at least partially vaporized natural gas stream and a condensed water stream;

b) cooling an exhaust gas stream from a gas turbine in a second heat exchanger via indirect heat exchange with a liquid stream to thereby produce a cooled exhaust gas stream and a first heated liquid stream;

c) passing the cooled exhaust gas stream through a $NO_x$ removal unit to thereby produce a $NO_x$-depleted cooled exhaust gas stream;

d) introducing the $NO_x$-depleted cooled exhaust gas stream into a lower inlet of a quench column;

e) immediately subsequent to its withdrawal from the first heat exchanger, introducing the vaporized natural gas stream into a third heat exchanger;

f) further heating the vaporized natural gas stream introduced into said third heat exchanger via indirect heat exchange with at least a portion of said first heated liquid stream withdrawn from the second heat exchanger to thereby produce a warmed natural gas product stream having a product temperature of at least 40° F. and a cooled liquid stream; and g) heating said cooled liquid stream withdrawn from said third heat exchanger in said quench column via direct heat exchange contact with said $NO_x$-depleted cooled exhaust gas stream to produce a further cooled exhaust gas stream and a second heated liquid stream, wherein said liquid stream used to cool said exhaust gas stream withdrawn from the gas turbine in said second heat exchanger comprises said second heated liquid stream; and h) adjusting the amount of heat transferred from the first heated liquid stream introduced into said third heat exchanger, wherein said adjusting is carried out to reduce the flow rate of the ambient air stream through said first heat exchanger while still heating said vaporized natural gas stream in the third heat exchanger to the product temperature.

2. The method of claim 1, further comprising, compressing an air stream in a compressor to provide a compressed feed air stream and introducing said compressed air stream and a combustion gas stream into said gas turbine to produce energy.

3. The method of claim 1, wherein said liquid stream comprises water.

4. The method of claim 1, wherein said cooled exhaust gas stream withdrawn from said second heat exchanger has a temperature of about 55° F. to about 400° F.

5. The method of claim 1, wherein said gas turbine generates energy; further comprising using at least a portion of said energy to produce electricity.

6. A system for vaporizing a liquefied natural gas stream, said system comprising:

a first heat exchanger comprising an ambient air inlet, a cooled air outlet, a liquefied natural gas inlet, and a vaporized natural gas outlet, wherein said first heat exchanger is adapted to heat and at least partially vaporize a liquefied natural gas stream via indirect heat exchange with an ambient air stream to produce a vaporized natural gas stream;

a second heat exchanger comprising a cool natural gas inlet, a heated natural gas outlet, a heated liquid inlet, and a cooled liquid outlet, wherein said cool natural gas inlet is in direct fluid flow communication with said vaporized natural gas outlet of said first heat exchanger, wherein said second heat exchanger is adapted to further heat said vaporized natural gas stream via indirect heat exchange with a heated liquid stream to produce a warmed product vaporized natural gas stream and a cooled liquid stream;

an air compressor comprising a feed air inlet and a compressed air outlet, said air compressor adapted to compress a stream of ambient air to produce a compressed air stream;

a gas turbine comprising a compressed air inlet, an exhaust gas outlet, and a rotating shaft, wherein said compressed air inlet is in fluid flow communication with said compressed air outlet of said air compressor, wherein said gas turbine is adapted to receive said compressed air stream from said compressor, generate energy to rotate said rotatable shaft, and discharge an exhaust gas stream from said exhaust gas outlet;

a third heat exchanger comprising a warm exhaust gas inlet, a cooled exhaust gas outlet, a warm liquid inlet, and a hot liquid outlet, wherein said warm exhaust gas inlet is in fluid flow communication with said exhaust gas outlet of said gas turbine, wherein said third heat exchanger adapted to cool said exhaust gas stream discharged from said gas turbine to produce a cooled exhaust gas stream;

a $NO_x$ removal unit comprising a gas inlet and a $NO_x$-reduced gas outlet, wherein said cooled exhaust gas outlet of said third heat exchanger is in fluid flow communication with said gas inlet of said $NO_x$ removal unit; and a quench column comprising an upper liquid inlet, a lower liquid outlet, a lower vapor inlet, and an upper vapor outlet, wherein said upper liquid inlet is in fluid flow communication with said cool liquid outlet of said second heat exchanger and said lower vapor inlet is in fluid flow communication with said $NO_x$-reduced gas outlet of said $NO_x$ removal unit, wherein said quench column is adapted to heat the cooled liquid stream exiting said second heat exchanger via direct heat exchange with said cooled exhaust gas stream exiting said third heat exchanger to produce a warmed liquid stream and a further cooled exhaust gas stream, wherein said lower liquid outlet of said quench column is in fluid flow communication with said warm liquid inlet of said third heat exchanger and said third heat exchanger is further adapted to further heat the warmed liquid stream via indirect heat exchange with said exhaust gas stream from said gas turbine, wherein said hot liquid outlet of said third heat exchanger is in fluid flow communication with said heated liquid inlet of said second heat exchanger, wherein said second heat exchanger is adapted to heat said vaporized natural gas stream via indirect heat exchange with the heated liquid stream withdrawn from said third heat exchanger to thereby produce a warmed natural gas product.

7. The system of claim 6, wherein said first heat exchanger further comprises a condensed water outlet for discharging water condensed during the cooling of said ambient air stream; and further comprising a fourth heat exchanger adapted to cool an air stream prior to its introduction into said air compressor, wherein said fourth heat exchanger comprises a cool water inlet, a warm water outlet, a warm air inlet, and a cool air outlet, wherein said condensed water outlet of said first heat exchanger is in fluid communication with said cool water inlet of said fourth heat exchanger and said cool air outlet of said fourth heat exchanger is in fluid flow communication with said feed air inlet of said compressor.

8. The method of claim 2, further comprising, cooling said air stream prior to said compressing to thereby provide a cooled, compressed air stream, wherein said cooled, compressed air stream and said combustion gas stream are introduced into said gas turbine.

9. The method of claim 8, wherein said cooling of said air stream prior to said compressing is at least partially carried out via indirect heat exchange with at least a portion of said condensed water stream exiting said first heat exchanger.

10. The system of claim 6, further comprising, a generator for generating electricity, wherein said generator is configured to be rotated by said gas turbine.

* * * * *